US008341795B2

(12) United States Patent
Michelson et al.

(10) Patent No.: US 8,341,795 B2
(45) Date of Patent: Jan. 1, 2013

(54) MOP

(75) Inventors: Robert Michelson, Wayland, MA (US); Robert Cavalcanti, Shrewsbury, MA (US); Michael Silverman, Westborough, MA (US)

(73) Assignee: Butler Home Products LLC, Marlborough, MA (US)

( * ) Notice: Subject to any disclaimer, the term of this patent is extended or adjusted under 35 U.S.C. 154(b) by 0 days.

(21) Appl. No.: 13/339,579

(22) Filed: Dec. 29, 2011

(65) Prior Publication Data

US 2012/0180236 A1 Jul. 19, 2012

Related U.S. Application Data

(62) Division of application No. 11/280,962, filed on Nov. 16, 2005, now Pat. No. 8,087,121.

(60) Provisional application No. 60/628,734, filed on Nov. 17, 2004.

(51) Int. Cl.

| | |
|---|---|
| ***A47L 13/10*** | (2006.01) |
| ***A47L 13/14*** | (2006.01) |
| ***A47L 13/20*** | (2006.01) |

(52) U.S. Cl. ..... 15/119.2; 15/244.4; 15/244.1; 15/228

(58) Field of Classification Search ..... 15/244.1, 15/244.4, 119.2, 228, 176.3, 119.1, 116.2, 15/231; 428/316.6, 317.9, 304.4, 317.1, 428/311.11

See application file for complete search history.

(56) References Cited

U.S. PATENT DOCUMENTS

| | | | | |
|---|---|---|---|---|
| 2,717,406 | A | 9/1955 | Herman | |
| 2,912,710 | A | 11/1959 | Vosbikian | |
| 3,178,749 | A | 4/1965 | Heepe | |
| 3,188,676 | A | 6/1965 | Zelinski | |
| 3,355,844 | A | 12/1967 | Abler | |
| 3,473,184 | A | 10/1969 | Buck, Jr. | |
| 3,727,259 | A | 4/1973 | Wilson | |
| 4,216,562 | A | 8/1980 | Strahs | |
| 4,285,086 | A | 8/1981 | Whyte | |
| 4,468,832 | A | 9/1984 | Batchelor | |
| 4,509,224 | A | 4/1985 | Batchelor | |
| 4,654,920 | A | 4/1987 | O'Neil, Jr. | |
| 4,882,804 | A | 11/1989 | Lucas | |
| 5,371,917 | A | 12/1994 | Hoagland | |
| 5,406,667 | A | 4/1995 | Teufel | |
| 5,416,945 | A | 5/1995 | Price | |
| 5,488,750 | A | 2/1996 | Vosbikian | |
| RE37,415 | E | 10/2001 | Petner | |
| 6,503,615 | B1 | 1/2003 | Horii | |
| 6,608,118 | B2 | 8/2003 | Kosaka | |
| 6,725,494 | B2 | 4/2004 | Cann | |
| 7,234,189 | B2 | 6/2007 | Chen | |
| 8,087,121 | B1 * | 1/2012 | Michelson et al. | 15/244.4 |
| 2005/0028309 | A1 | 2/2005 | Boyer | |
| 2005/0136238 | A1 | 6/2005 | Lindsay | |
| 2006/0003912 | A1 | 1/2006 | Lindsay | |

(Continued)

*Primary Examiner* — Gary Graham
(74) *Attorney, Agent, or Firm* — McCarter & English, LLP

(57) ABSTRACT

A disposable liquid absorbing cleaning pad for a mop includes a layer of sponge material, a layer of flexible open cell foam material made from melamine resin fixedly attached to the layer of sponge material and attachment structure secured to the layer of sponge material for removably attaching the cleaning pad to the mop. In using the cleaning pad, the layer of flexible open cell foam material made from melamine resin is the layer that contacts the surface to be cleaned. The cleaning pad may be provided with a suitable attachment structure for mounting the pad onto a butterfly mop, a squeeze mop or a roller mop.

3 Claims, 12 Drawing Sheets

U.S. PATENT DOCUMENTS

| | | | |
|---|---|---|---|
| 2006/0005338 | A1 | 1/2006 | Ashe |
| 2006/0229229 | A1 | 10/2006 | Bednarz |
| 2006/0230569 | A1 | 10/2006 | Chen |
| 2007/0061991 | A1 | 3/2007 | Gonzales |
| 2007/0130710 | A1 | 6/2007 | Chen |
| 2007/0151064 | A1 | 7/2007 | O'Connor |
| 2007/0161533 | A1 | 7/2007 | Gonzales |
| 2008/0016640 | A1 | 1/2008 | Reddy |

* cited by examiner

MOP

CROSS-REFERENCE TO RELATED APPLICATIONS

The present application is a divisional application from U.S. patent application Ser. No. 11/280,962 filed on Nov. 16, 2005, now U.S. Pat. No. 8,087,121 which claims the benefit under 35 USC 119(e) of U.S. Provisional Patent Application Ser. No. 60/628,734, filed Nov. 17, 2004, the disclosure of each of which are incorporated herein by reference.

BACKGROUND OF THE INVENTION

The present invention relates to mops and more particularly to sponge mops.

Sponge mops are well known in the art and widely used for cleaning hard surfaces such as hardwood floors, ceramic tile floors, marble floors and the like. The liquid with which these mops are intended to be used is usually water or some type of aqueous solution. Sponge mops usually include a disposable liquid absorbing cleaning pad having a layer of sponge material which is used for cleaning and moisture absorbing, and an attachment structure, the construction of the attachment structure depending on the particular type of mop, for attaching the cleaning pad to the head of the mop. After being used a number of times the cleaning pad is discarded and usually replaced with a refill cleaning pad. Examples of the layer of sponge material are natural sponges, polyester foams, polyurethane foams, cellulose and absorbent arrays of synthetic fibers.

The three most common types of sponge mops are the squeeze mop, the butterfly mop and the roller mop.

One very well known type of squeeze mop includes a handle, a head attached to the handle, a mounting plate attached to the head, a disposable liquid absorbing cleaning pad which includes a layer of sponge material and a backing plate, the layer of sponge material being fixedly secured to the backing plate, means for removably attaching the backing plate to a mounting plate on the head and a squeeze plate hingedly attached to the mounting plate for extracting liquid collected by the cleaning pad during use.

Butterfly mops differ from squeeze mops among other things in that the cleaning pad is mounted on a pair of hinged wing plates coupled to the head of the mop rather than a mounting plate and which can open and close in much the same way as the wings do on a butterfly in order to remove liquid from the cleaning pad.

Roller mops differ from squeeze mops among other things in that they include a pair of rollers rather than a squeeze plate for squeezing water from the cleaning pad.

Sponge mops very often also include a layer of scrubber material or a scrubber brush for cleaning excessively soiled areas.

In U.S. Pat. No. 4,285,086 to A. J. Whyte, there is disclosed a squeeze mop which includes a compressible head of sponge rubber or the like and a wringing mechanism which comprises a presser plate pivotal into compressive engagement with the mop head, an operating lever pivotally mounted on the mop handle, a cam lever pivotally connected to the operating lever and a cam disposed on the end of the cam lever such that actuation of the operating handle causes the cam to reciprocate over the surface of the presser plate while pivotally urging the presser plate into compressive engagement with the mop head.

In U.S. Pat. No. 5,416,945 to W. O. Price, there is disclosed a squeeze mop which comprises a backing plate upon which both a sponge and a scrubber strip have been mounted so as to expose an edge of said backing plate for use as a cleaning tool. Said backing plate may be heated and thereafter said sponge may be heat fused to said backing plate and said scrubber strip may be heat fused to said backing plate in perpendicular fashion to said sponge so as to expose an edge of said backing plate for use as a cleaning tool.

In U.S. Pat. No. 6,725,494 to R. A. Cann, there is disclosed a butterfly mop which includes a self-contained wringing mechanism comprising only two molded parts, an actuating lever and an enclosed yoke. A pair of hinged wings can be internally molded onto one end of the actuating lever, and the lever can rotate back and forth within the enclosed yoke. Guides within the yoke can swing the wings closed when the lever is moved forward, squeezing a detachable increase as it is moved forward. Moving the lever back to its original position can cause the wings to swing back open, aided by the compression of the sponge.

In U.S. Pat. No. 5,488,750 to P. S. Vosbikian, there is disclosed a butterfly mop which is used for routine surface cleaning and moisture absorbing mopping and an integral unitary mop scrubber attachment with an outer abrasive surface which is to be used on the head of the sponge mop for cleaning more difficult and ingrained soiled surfaces. The mop attachment consists of two detent tabs which are to be inserted into the existing cutouts located in the sponge support member of the mop. The attachment also has side holes for placement over the existing holes of the mop's support member, through which the ends of the mop's squeeze arms are inserted. The mop attachment is readily and easily removable from the sponge mop and is interchangeably designed to be used with existing or new butterfly sponge mops. In another embodiment the mop attachment and the mop's sponge support member is formed with the scrubber component as a single, molded plastic component.

In U.S. Pat. No. 3,727,259 to F. G. Wilson, there is disclosed a roller mop which comprises a wringer mop head replacement and actuator mechanism including a pair of spaced parallel wringer rollers carried at the lower end of a housing through which housing extends an operating crank upward through a hollow handle to pivotal securement with a pivoted crank handle, and which operating crank detachably connects at its lower end to the mop head by means of a cooperating snap-latch carried by the mop head. The crank handle is shiftable between up and detented center positions to similarly shift the operating crank and wring out the mop head by passing it between the rollers, and is shiftable to a down position to expel the mop head and lower end of the operating crank from the housing and from between the rollers to completely expose the snap-latch connection for fast mop head replacement. The mop head snap-latch consists of an inverted channel member holding a sponge absorbent element by compression of a marginal edge of the sponge between the channel member walls, the center of the channel base wall having an upstanding tunnel formation into which the operating crank lower end hook arm is slidable with the latter held in position by a shiftable latch plate biased resiliently upward by the sponge material to capture the hook arm.

In U.S. Patent Application Publication No. 2005/0028309A1 there is disclosed a butterfly mop having an elongate shaft with a mop element disposed at one end of the shaft and a wringer connected to the shaft and the mop element. In preferred embodiments, the wringer includes a channel body having first and second leg portions defining a channel there between. The mop element includes a foldable, compressible, liquid-absorbent member, a mounting element having first and second support portions connected by a flexible member, and a scrubber mounted to the mounting element. The mop element and channel body are movable relative to one another, whereby the mop element may be drawn into the channel causing the mop element to fold along a central transverse axis and to become compressed between the channel body leg portions. The wringer includes a handle and an actuator link connecting the handle to one of the mop element and channel body for effecting relative hinged movement thereof. In some embodiments, the mop element includes a support that has first and second support portions and a flexible member connecting the first and second support portions. In certain embodiments, a fastener having a barbed shaft is used to connect the mop element to the wringing mechanism to the mop.

In U.S. Pat. No. 4,654,920 to W. J. O'Neil, Jr. et al. there is disclosed a roller mop having a scrubber attachment which is fixedly mounted thereon without any extra, attaching hardware. The scrubber attachment carries a scrubber pad and is fixedly secured to the mop head at a predetermined angle. This combination yields a mop capable of both conventional sponge cleaning and of abrasively rubbing to effect further cleansing treatment of a surface without the risk of moving the scrubber out of operative position during use.

In U.S. RE 37,415E there is disclosed roller sponge mop which is used for routine floor surface or similar surface cleaning and moisture absorbing mopping is combined with an integral mop attachment with an outer abrasive surface, designed and formed to be positioned within a wall surface of the lower frame of the mop, to be used for cleaning more difficult and ingrained soiled surfaces. The attachment is removable and interchangeable for use on similarly configured roller mops. The sponge mop roller squeeze feature is actuated by a cammed lever which is rotatably connected to the mop's handle and is positioned adjacent to a sleeve slid able mounted on the handle. At its lower end, the sleeve comprises the frame which carries the mop attachment and connects to the mop's rollers. The bias action of a spring at the lower end of the handle maintains the sponge element of the mop in the cleaning position. As the lever is moved against the sleeve and toward the rollers, the handle is caused to move away from the rollers, drawing the sponge element between the rollers, squeezing dirt and water out of the sponge member. Releasing the lever causes the spring to return the handle and the sponge member to the cleaning position. Tabs on the sleeve and camming lever interact to lock the sleeve and handle to hold and maintain the sponge element between the rollers independent of the use of manually exertion. In this manner, the abrasive surface can be sued without interference from the extended sponge element. A handle attachment piece is secured at one end to the handle and at the other end comprises bottom walls. The bottom walls are self-aligning with corresponding ridged openings on the channel member which holds the sponge element. This alignment system allows for simply and easily replacement of the sponge element of the mop.

There is currently in the marketplace a hand held disposable liquid absorbing cleaning pad especially useful in cleaning walls, bathroom and kitchen fixtures and the like which is rectangularly shaped and which consists of a layer of sponge material bonded to a layer of flexible open cell foam material made from melamine resin. The layer of flexible open cell foam material is manufactured by BASF Corporation in Ludingshaffen, Germany and sold under the name BASOTECT. The layer of flexible open cell foam material made from melamine resin is bonded to the layer of sponge material and marketed by Proctor & Gamble in Cincinnati, Ohio under the name Magic Eraser. In use, the layer of open cell foam material is the layer that contacts the surface to be cleaned. The length, width and thickness of the pad is about 4¾ inches by 2 Y2 inches by 1 1/16 inches and the thickness of the layer of flexible open cell foam material is about ⅞ of an inch.

Although sponge mops comprising a disposable liquid absorbing cleaning pad are generally adequate for their intended purpose, they are not always completely satisfactory in successfully removing all types of soils from hard surfaces.

Also, because of certain structural differences, a refill cleaning pad made for one manufacturer's mop will not always fit onto another manufacturer's mop of the same type.

Accordingly, it is an object of this invention to provide a new and improved mop of the type having a disposable liquid absorbing cleaning pad. It is another object of this invention to provide a new and improved disposable liquid absorbing cleaning pad for use in a sponge mop.

It is still another object of this invention to provide a cleaning pad for a squeeze mop which has attaching structure which can be adjusted to accommodate a variety of different manufacturer's squeeze mops.

It is yet still another object of this invention to provide a new and improved refill for a sponge mop having a disposable liquid absorbing cleaning pad.

SUMMARY OF THE INVENTION

According to one aspect of this invention there is provided a disposable liquid absorbing cleaning pad for a squeeze mop, the squeeze mop having a head, a mounting plate on the head onto which the cleaning pad can be mounted and a squeeze plate attached to the mounting plate, the disposable liquid absorbing cleaning pad comprising a layer of sponge material, a layer of a flexible open cell foam material made from melamine resin fixedly attached to the layer of sponge material, a backing plate fixedly mounted onto the layer of sponge material and means for removably attaching the backing plate onto the mounting plate.

According to another aspect of this invention there is provided a disposable liquid absorbing cleaning pad for a butterfly mop, the butterfly mop having a pair of pivotally mounted base plates, the disposable liquid absorbing cleaning pad comprising a layer of sponge material, a layer of a flexible open cell foam material made from melamine resin fixedly attached to the layer of sponge material and a backing plate fixedly mounted onto the layer of sponge material, the backing plate being adapted to be removably mounted on the pair of pivotably mounted base plates.

According to another aspect of this invention there is provided a disposable liquid absorbing cleaning pad for a roller mop, the roller mop having a pair of rollers and an operating crank, the disposable liquid absorbing cleaning pad comprising a layer of sponge material, a layer of a flexible open cell foam material made from melamine resin fixedly attached to the layer of sponge material, and an operating crank holder attached to the layer of sponge material and adapted to be removably attached to the operating crank.

According to another aspect of this invention there is provided a disposable liquid absorbing cleaning pad for a squeeze mop, the squeeze mop having a head and a mounting plate attached to the head, the liquid absorbing cleaning pad comprising a layer of sponge material, a backing plate fixedly mounted onto said layer of liquid absorbing material and having a pair of longitudinally disposed slotted pockets and slidably mounted and removable means for attaching said backing plate onto said mounting plate.

According to another aspect of this invention there is provided a squeeze mop comprising a handle, a head mounted on the handle at one end thereof, a mounting plate attached to said head, a squeeze plate coupled to the head, a disposable liquid absorbing cleaning pad having a layer of flexible open cell foam material made from melamine resin, a layer of sponge material attached to the layer of flexible open cell foam material made from melamine resin, a backing plate attached to the layer of sponge material and means for removably attaching the backing plate to the mounting plate and to the squeeze plate.

According to another aspect of this invention there is provided a butterfly mop comprising a handle, a head mounted on the handle, the head having a base plate, a pair of hinged wing plates attached to the base plate, a disposable liquid absorbing cleaning pad having a layer of flexible open cell foam material made from melamine resin, a layer of sponge material attached to the layer of flexible open cell foam material made from melamine resin and a backing plate, the backing plate being fixedly attached to the layer of sponge material and means for removably attaching the backing plate to the pair of hinged wing plates.

According to another aspect of this invention there is provided a roller mop comprising a handle, a pair of rollers and an operating crank, a disposable liquid absorbing cleaning pad having a layer of flexible open cell foam material made from melamine resin; a layer of sponge material attached to the layer of flexible open cell foam material and attachment structure attached to the layer of sponge material and coupled to the operating crank.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like characters represent like parts.

DETAILED DESCRIPTION OF THE PREFERRED EMBODIMENTS

Figure 1:
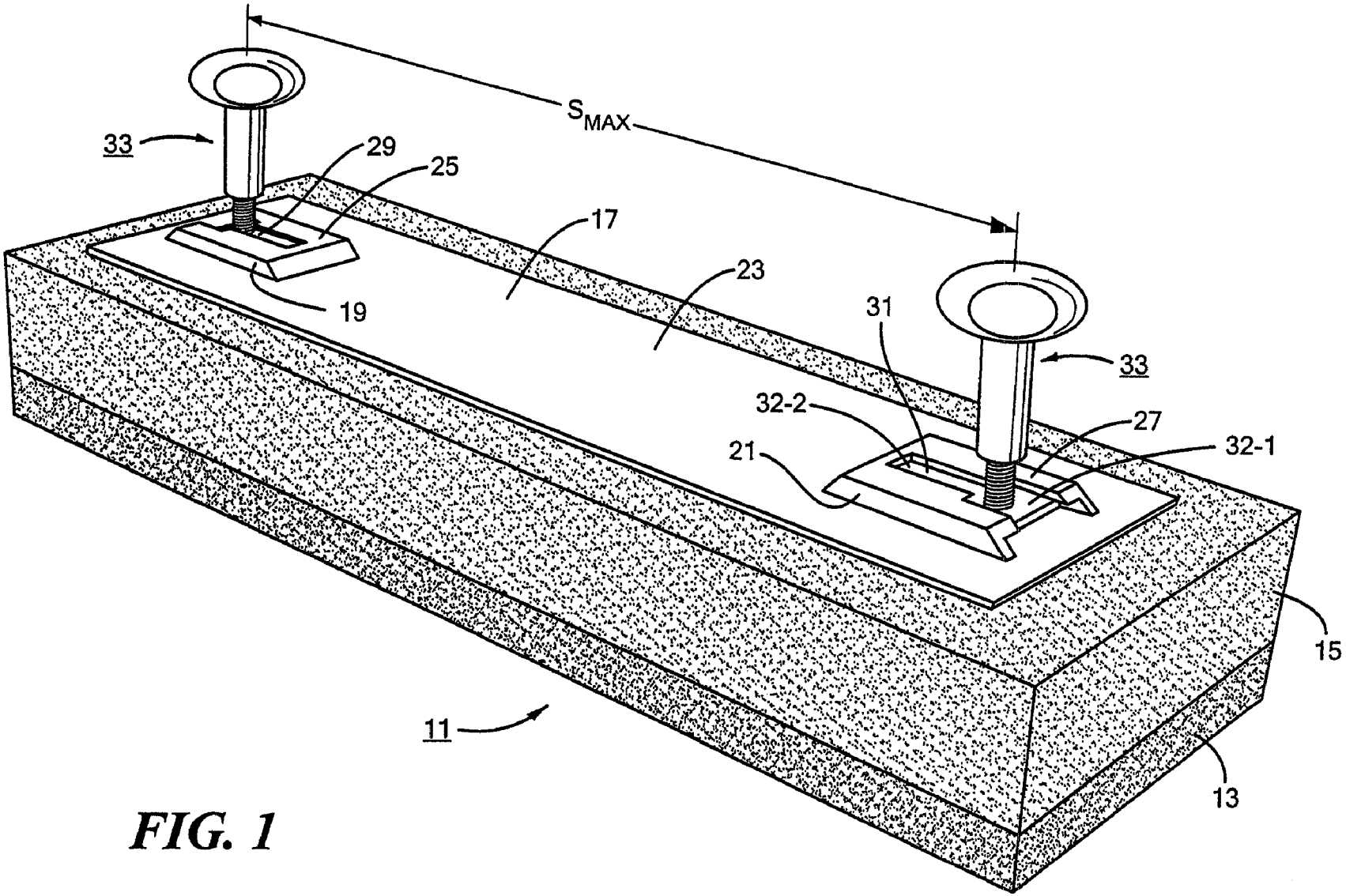
FIG. 1 is a perspective view taken from the top of one embodiment of a cleaning pad for a squeeze mop constructed according to this invention, with the wing screw assemblies arranged on the backing plate for maximum spacing.
Figure 2:
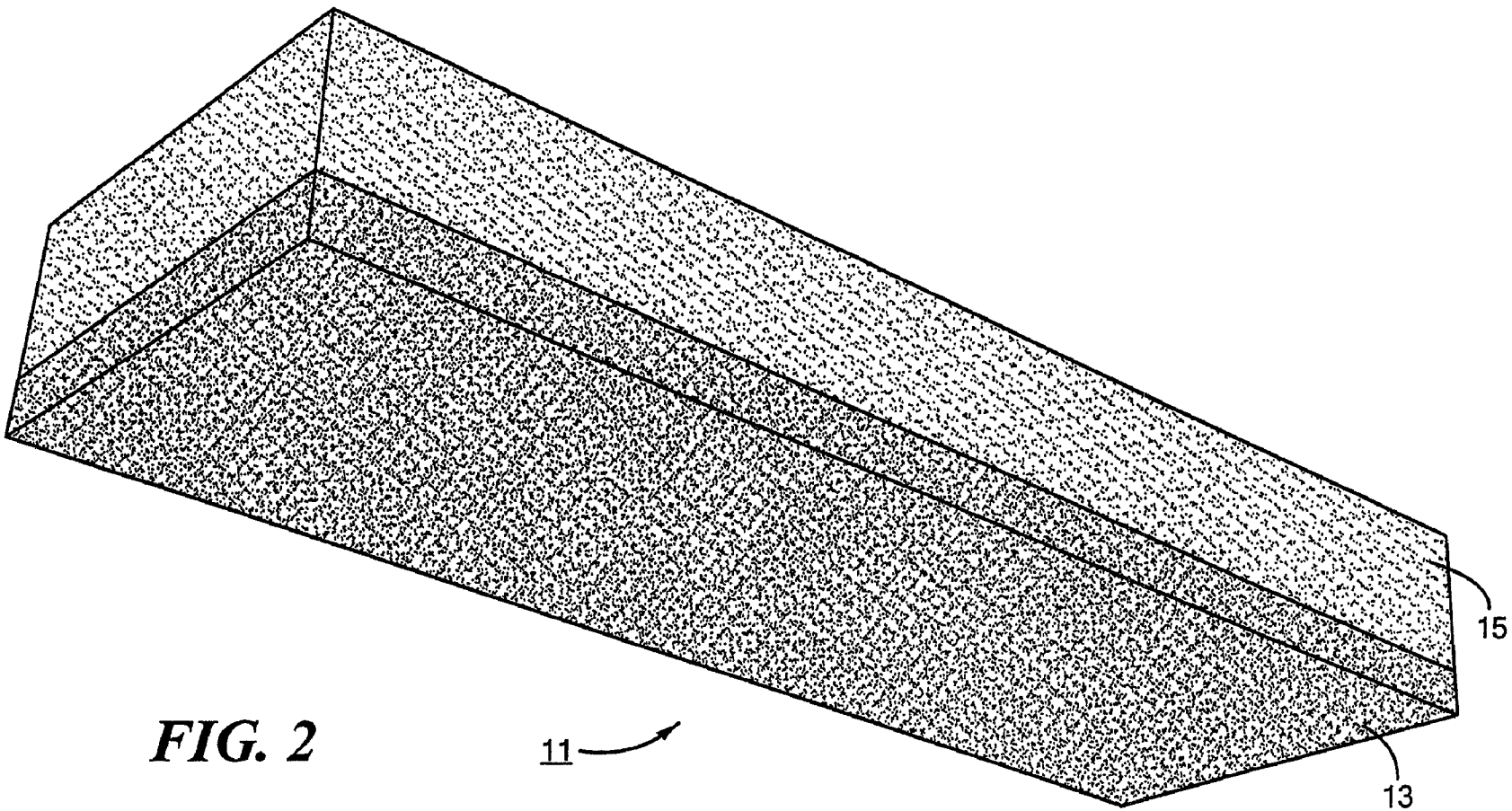
FIG. 2 is a perspective view taken from the bottom of the cleaning pad shown in FIG. 1.
Figure 3:
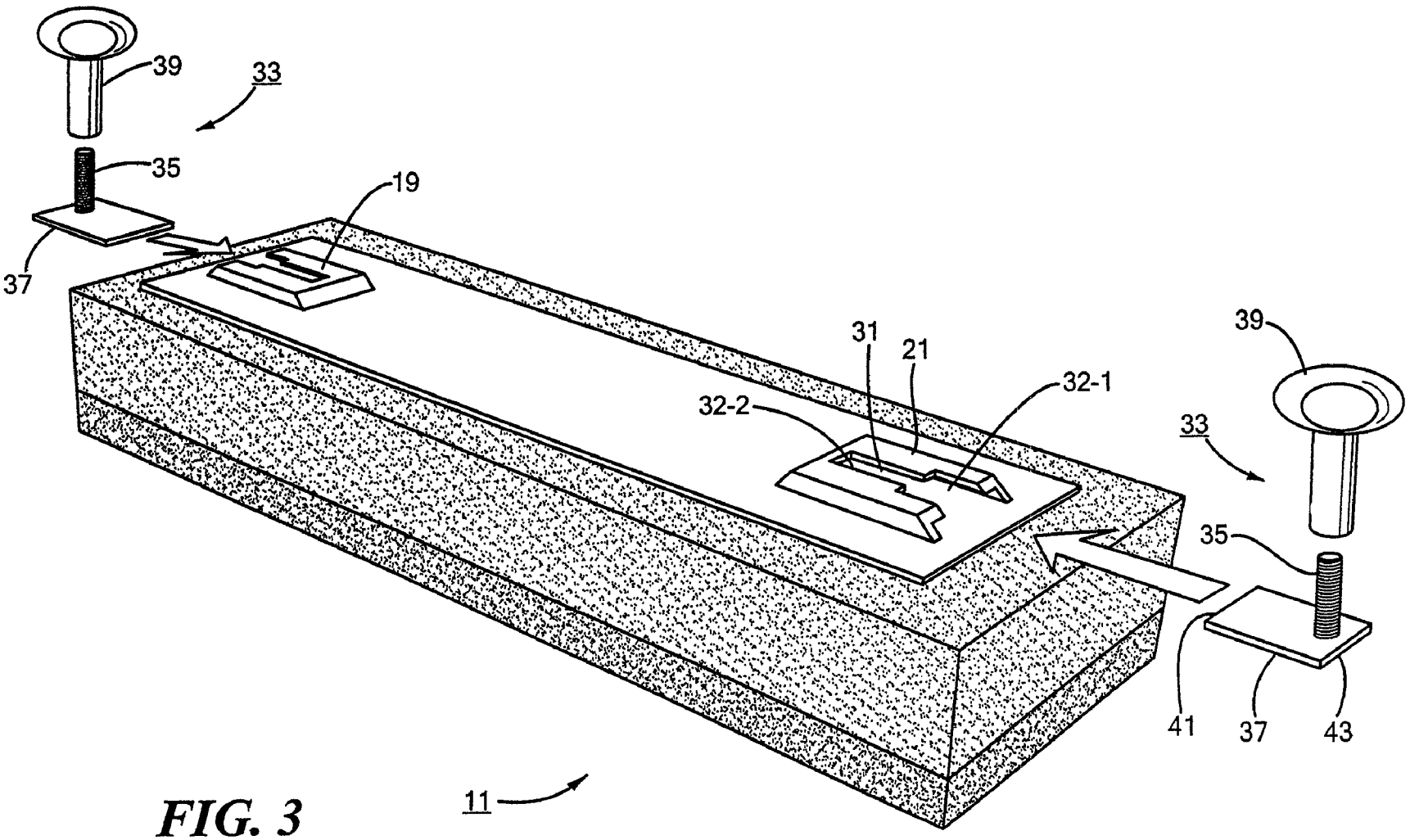
FIG. 3 is a perspective view partly exploded of the cleaning pad shown in FIG. 1.

The present invention is directed to a sponge mop in which the cleaning pad comprises a layer of open cell foam material made from melamine resin which is used for cleaning and moisture absorbing in addition a layer of sponge material. The present invention is also directed to a disposable liquid absorbing cleaning pad for a squeeze mop which can be used with a variety of differently constructed squeeze mops. Referring now to the drawings, there is shown in FIG. 1 a perspective view taken from the top of a disposable liquid absorbing cleaning pad according to this invention and identified by reference numeral 11. A perspective view of cleaning pad 11 taken from the bottom is shown in FIG. 2 and a partly exploded view of the cleaning pad 11 is shown in FIG. 3.

Cleaning pad 11, which is generally rectangularly shaped includes a layer 13 of flexible open cell foam material made from melamine resin. A layer 15 of sponge material, such as polyester foam, is bonded to layer 13 by a suitable adhesive (not shown), such as moisture curable polyurethane. Examples of other material for layer 15 of sponge material are natural sponges, polyurethane foams, cellulose and absorbent arrays of synthetic fibers. A backing plate 17 for removably securing cleaning pad 11 to a squeeze mop is fixedly attached by a suitable adhesive, such as glue, to the layer 15 of sponge material.

Backing plate 17 is an elongated rectangularly shaped plate of plastic material having a length of about 8½ inches, a width of about 2 inches and a thickness of about 1/16 of an inch. A pair of opposed pockets 19 and 21 are integrally formed on the top surface 23 of backing plate 17. Each pocket 19 and 21 includes a top wall 25 and 27, respectively, having a slot 29,31, respectively. Each slot 29,31 has an outer portion 32-1 and an inner portion 32-2, outer portion 32-1 being wider than inner portion 32-2.

Cleaning pad 11 further includes a pair of wing screw assemblies 33 for use in removably securing cleaning pad 11 to the head of a squeeze mop. Each wing screw assembly 33 is slidably and removably mounted in one of the pockets 19 and 21. Each wing screw assembly 33 includes a screw 35 which is fixedly mounted off-center on a thin rectangularly shaped metal plate 37 which is slidably and removably mounted in one of the pockets 19 and 21 and a wing nut 39 which is removably screwed onto screw 35.

In use, screws 35 extend through a pair of cleaning pad mounting holes on the mounting plate of the squeeze mop and then tightened using wings nuts 39 to removably attach backing plate 17 to the mounting plate of the squeeze mop.

As can be seen, screw assemblies 29 can be positioned at any location along slots 29 and 31 with either end 41 and 43, inserted first. As a result, cleaning pad 11 will accommodate a variety of different mounting hole spacings.

Figure 4:
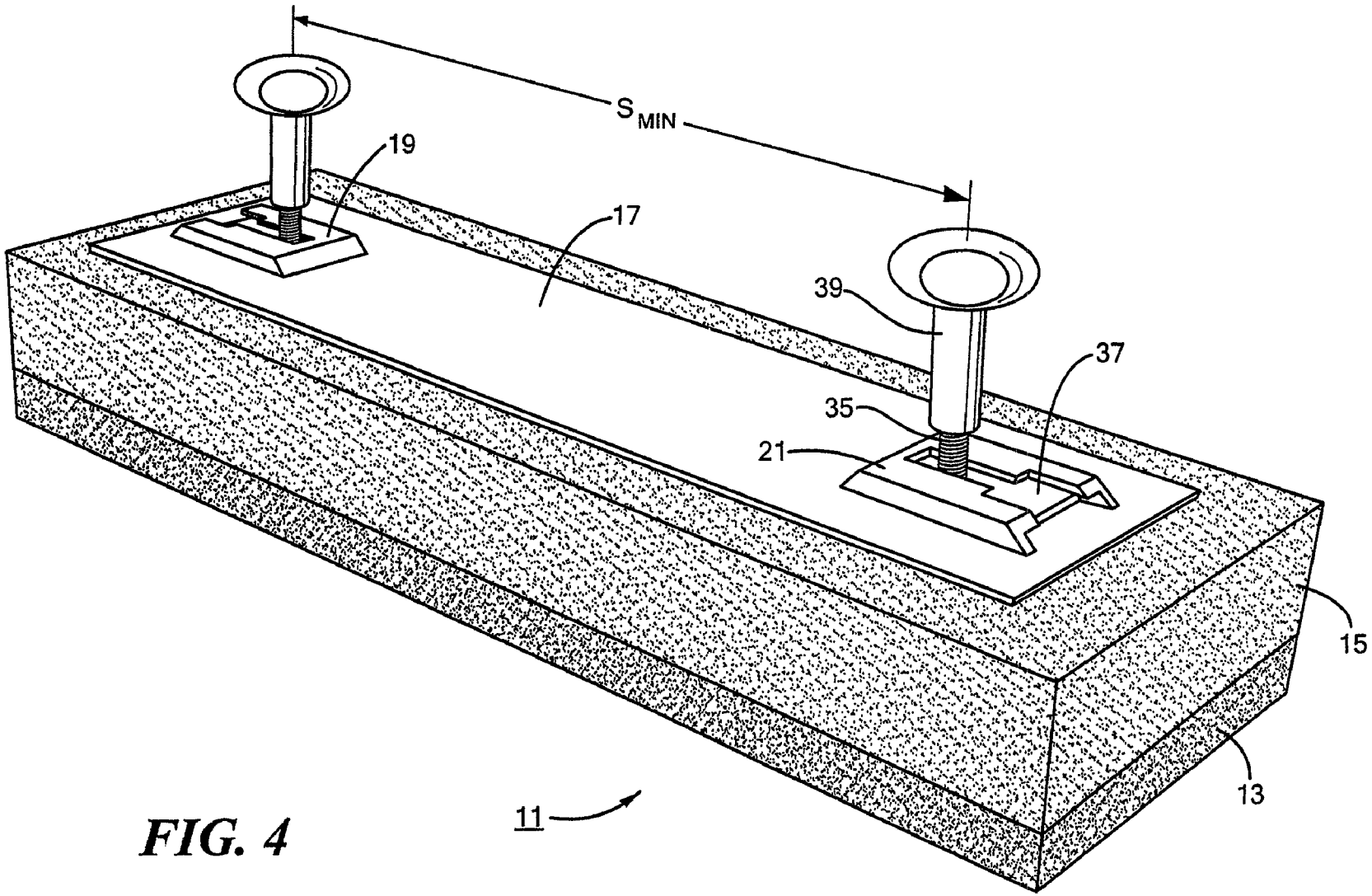
FIG. 4 is a top perspective view of the cleaning pad shown in FIG. 1 with the wing screw assemblies positioned in the pockets on the backing plate for minimum spacing.

FIG. 1 shows wing screw assemblies 33 positioned on backing plate 17 for maximum spacing ($S_{MAX}$) and FIG. 4 shows wing screw assemblies 33 positioned on backing plate 17 for minimum spacing ($S_{MIM}$).

The flexible open cell foam material made from melamine resin is manufactured by BASF corporation in Ludwigshaffen, German and sold under the name BASOTECT. The length $L_1$, width $W_1$ and height $H_1$ of cleaning pad 11 may be, for example, 9½ inches, 3 inches and 1½ inches, respectively. The thickness $T_1$ of layer 13 may be for example 7/16 of an inch. It should be noted, however, that these dimensions are by way of example, only, and that layer 13 and pad 11 may have other dimensions.

To use pad 11, after it is attached to a mop, layer 13 is wet with water or other liquid in the same way as the Magic Eraser is used.

In assembling pad 11, backing plate 17 is first attached to sponge layer 15. Then, foam layer 13 is bonded to sponge layer 15.

Cleaning pad 11 can be used either as part of a new squeeze mop or as a refill for an existing squeeze mop.

Figure 5:
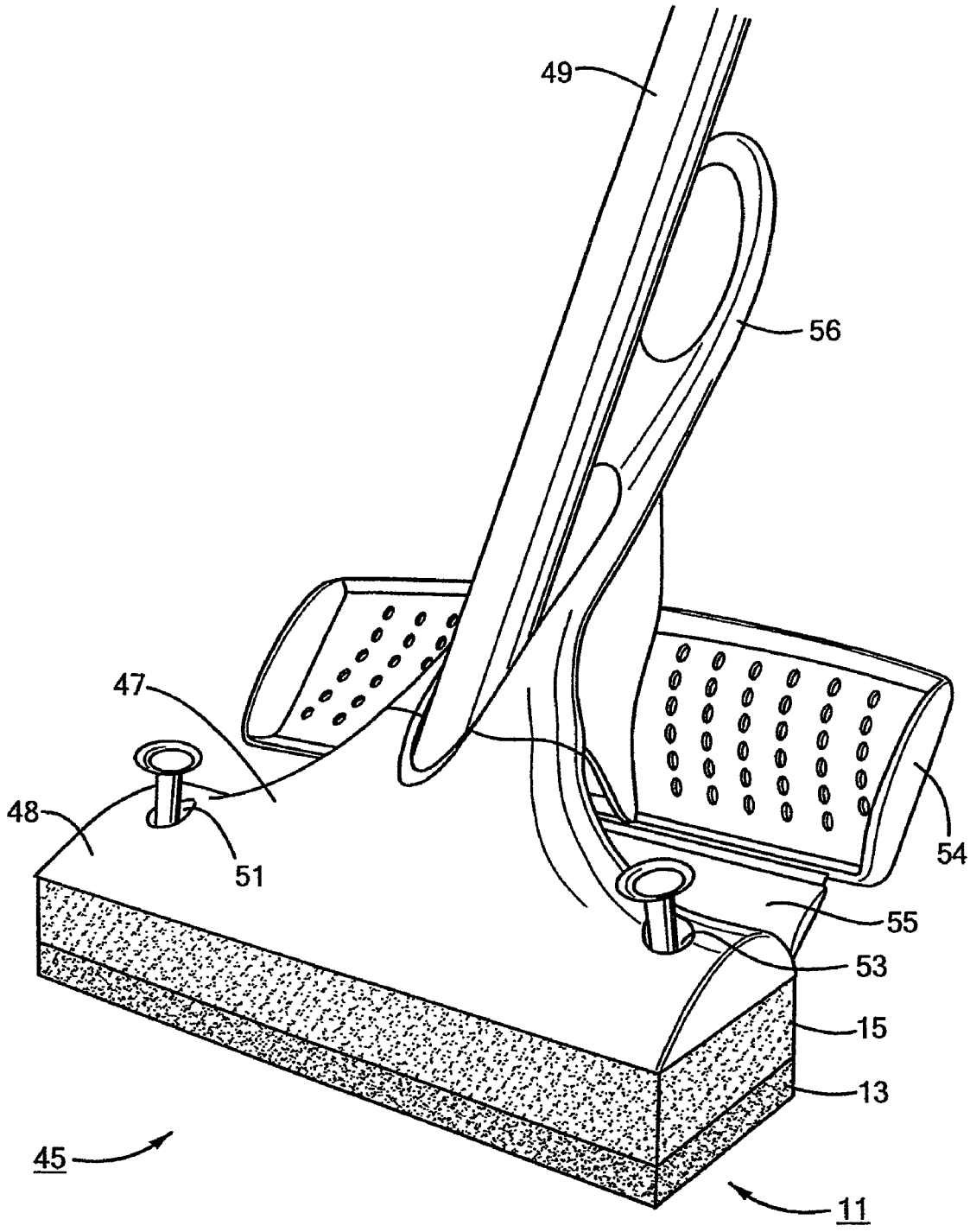
FIG. 5 is a fragmentary perspective view of a squeeze mop constructed according to this invention using the cleaning pad shown in FIG. 1.

In FIG. 5 is shown a squeeze mop 45 constructed according to this invention using cleaning pad 11.

Squeeze mop 45 includes a mop head 47, a mounting plate 48 integrally formed with mop head 47, a mop handle 49 removably attached to mop head 47, a cleaning pad 11 removably attached to mounting plate 48 by wing screw assemblies 33 which extend through mounting holes 51 and 53 in mounting plate 48, a squeeze plate 54 attached by a living hinge 55 to mounting plate 48 and a squeeze plate handle 56 fixedly attached to squeeze plate 54.

Figure 6:
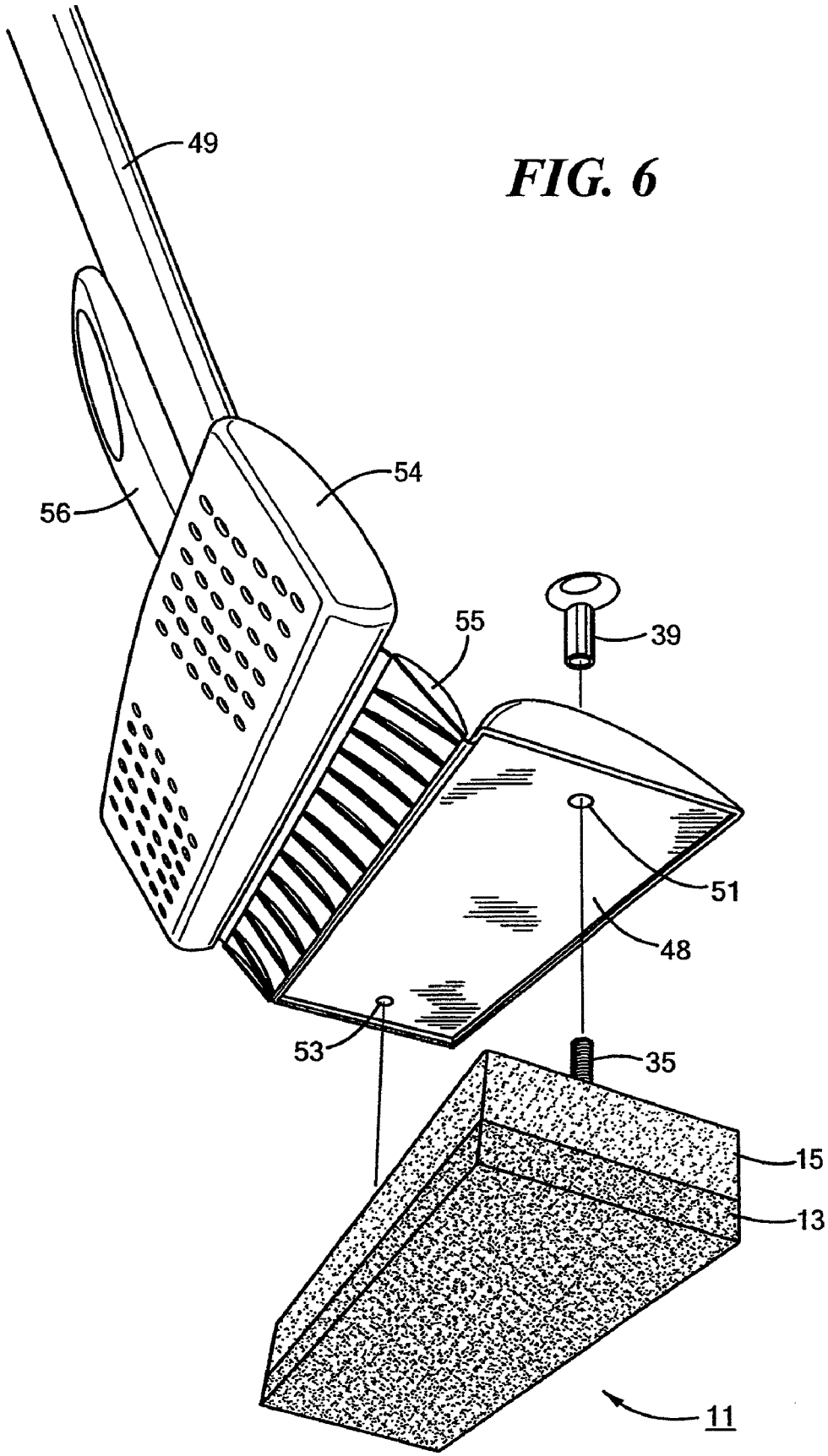
FIG. 6 is a fragmentary perspective view taken from the bottom and partially exploded of the mop shown in FIG. 5.

An exploded view of squeeze mop 45 taken from the bottom is shown in FIG. 6.

Mop 45 is sued in a conventional manner.

Figure 7:
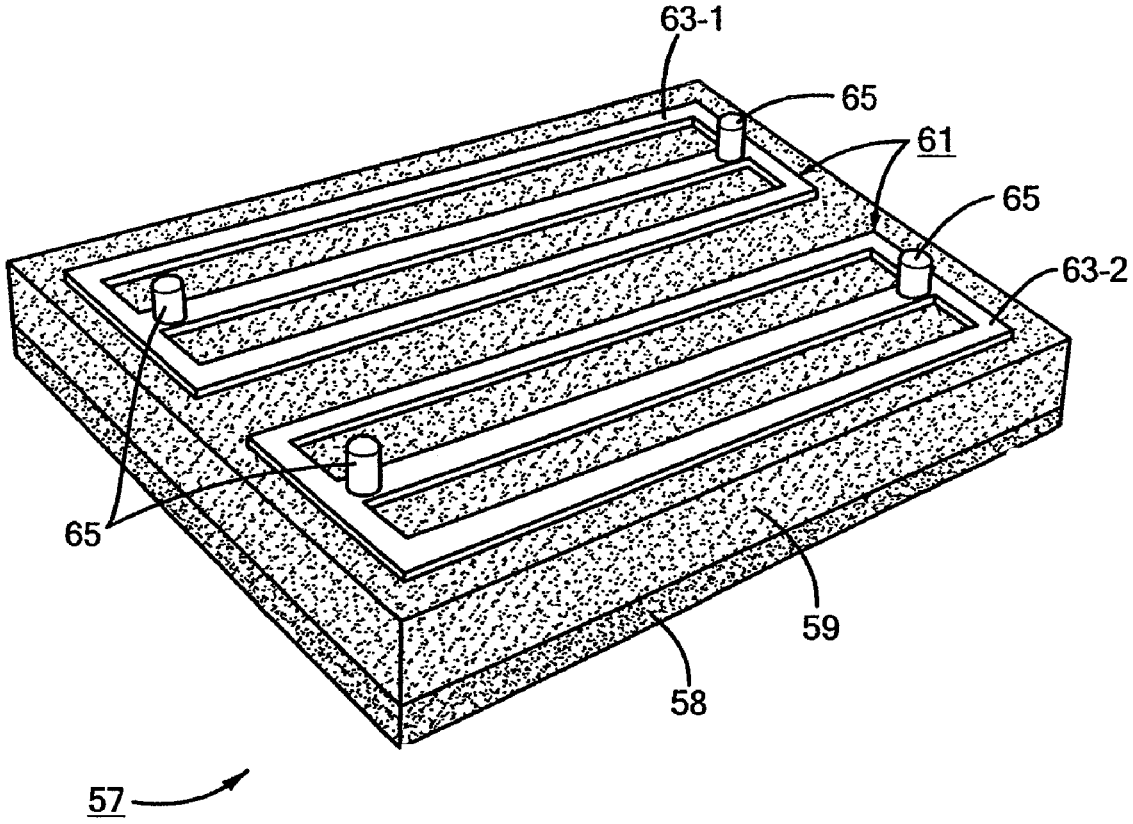
FIG. 7 is a perspective view of another embodiment of a cleaning pad for a squeeze mop constructed according to this invention.

In FIG. 7 is shown a perspective view of another embodiment of a cleaning pad for another type of squeeze mop constructed according to this invention and identified by reference numeral 57.

Cleaning pad 57 includes a layer 58 of flexible open cell foam material made form melamine resin, a layer 59 of sponge material bonded to layer 58 and a backing plate 61 made up of frame sections 63-1 and 63-2 for removably securing pad 55 to a squeeze mop. Frame sections 63-1 and 63-2 are fixedly attached by a suitable adhesive (not shown) to layer 59. Backing plate 61 includes four pins 65 for removably attaching pad 57 by a press fit to the mounting plate and also to the squeeze plate of a squeeze mop. The length, width and thickness of pad 57 are about 8 inches by about 4/916 inches by about 1/12 inches respectively. These dimensions are by way of example only. Cleaning pad 57 can be used either as a part of a new mop or as a refill for an existing mop.

Figure 7A:
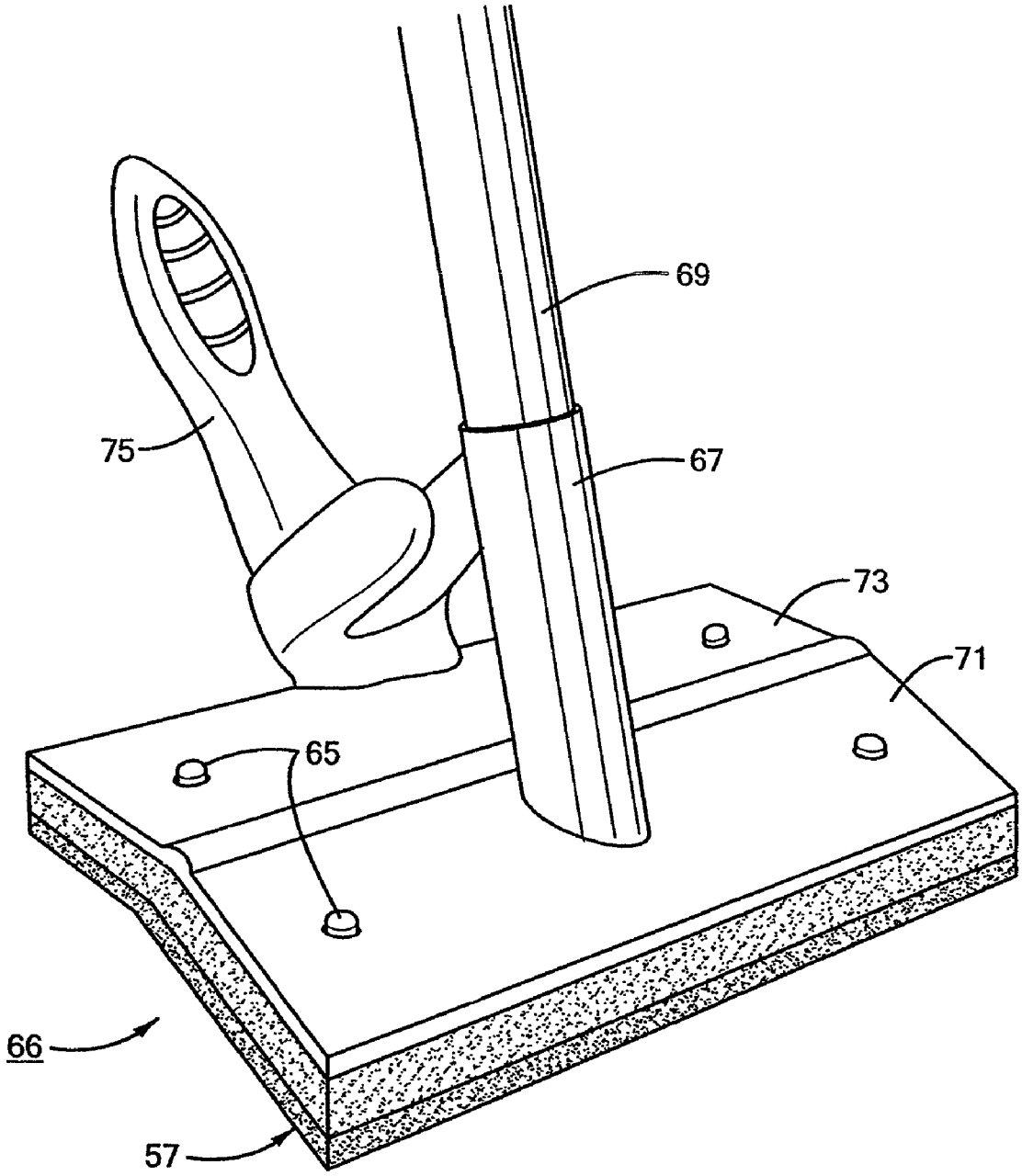
FIG. 7A is a fragmentary perspective view of a squeeze mop using the cleaning pad shown in FIG. 7.

In FIG. 7A is shown a fragmentary perspective view of squeeze mop constructed using cleaning pad 57 and identified by reference numeral 66.

Squeeze mop 66 includes a head 67, a handle 69 removably mounted on mop handle 67 at one end thereof, a mounting plate 71 fixedly secured to head 67, a squeeze plate 73 hingedly connected to mounting plate 71, a squeeze plate handle 75 fixedly secured to squeeze plate 73, a cleaning pad 55, cleaning pad 55 including a backing plate 61 having a plurality of attachment pins 65, cleaning pad 55 being removably mounted on mounting plate 71 and also on squeeze plate 73. To assemble the mop, attachment pins 65 are pushed up through mounting holes 68 in head 69 and squeeze plate 71 to removably secure pad 55 onto head 69 and squeeze plate 71. As can be seen, the main differences between squeeze mop 45 and squeeze mop 66 are, in addition to the overall size of the cleaning pads, that in squeeze mop 45 cleaning pad 11 is removably mounted only on head 47 whereas in squeeze mop 66 cleaning pad 55 is removably mounted on mop head 69 and also on squeeze plate 73. Also, the attachment structure in mop 45 is wing screw assemblies 33 while in mop 665 the attachment structure is attachment pins 66.

Figure 8:
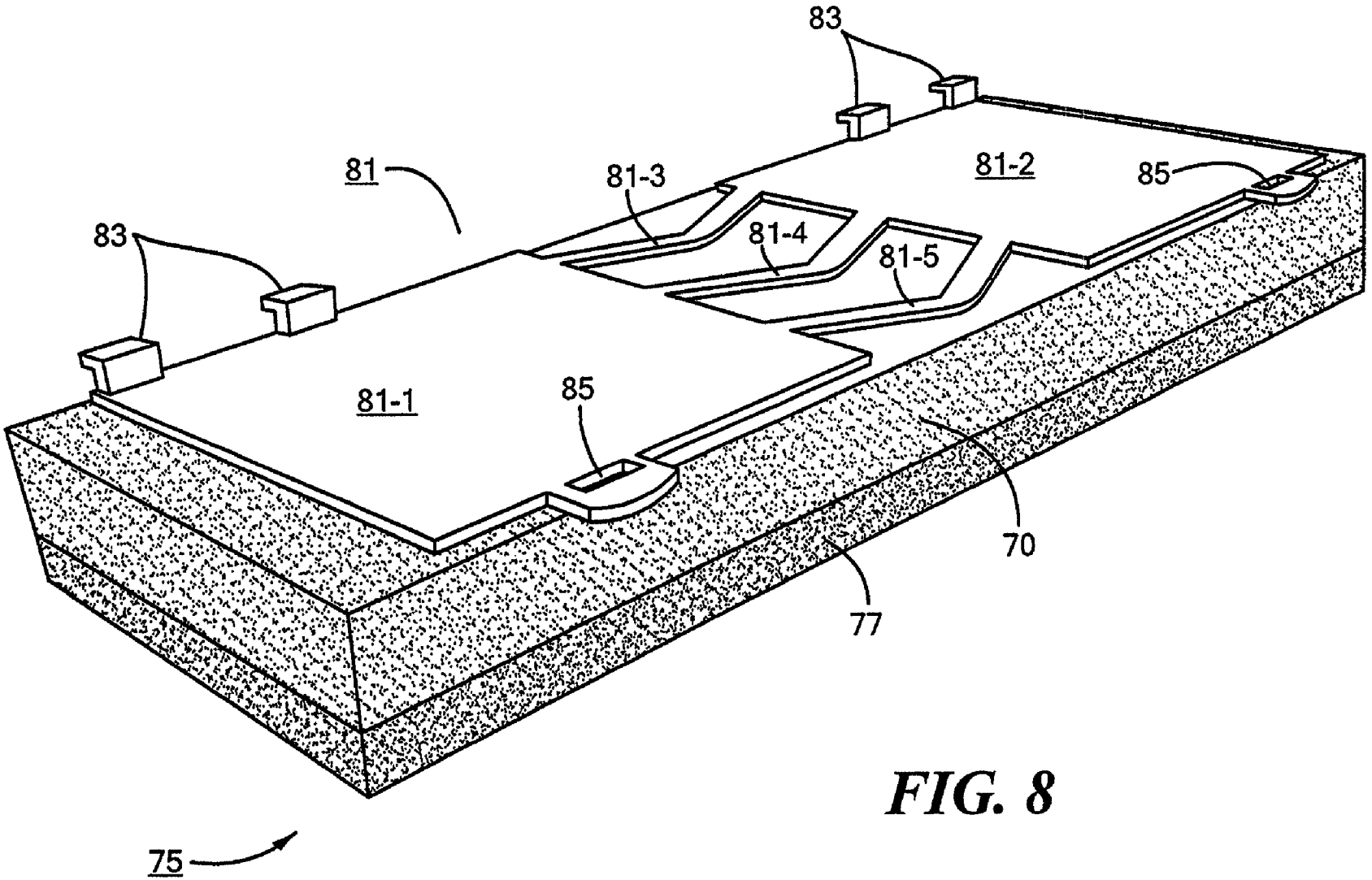
FIG. 8 is a perspective view of a cleaning pad constructed according to this invention for use on a butterfly mop.

In FIG. 8 is shown a perspective view of a cleaning pad constructed according to this invention for use on a butterfly mop, the cleaning pad being identified by reference numeral 75. Cleaning pad 75 includes a layer 77 of flexible open cell foam material made form melamine resin, a layer 79 of sponge material bonded to layer 77 by any suitable means (not shown) and a backing plate 81 made of plastic fixedly secured to sponge layer 79 by any suitable means (not shown), backing plate 81 comprising a pair of plate sections 81-1 and 81-2 connected by a hinge portion made up of three strips 81-3,81-4 and 81-5. Each section 81-1 and 81-2 includes two tabs 83 and one slot 85 for removably attaching backing plate 81 to a pair of hinged wing plates on the mop. Pad 75 can either be a part of a new mop or a refill for an existing mop.

Figure 9:
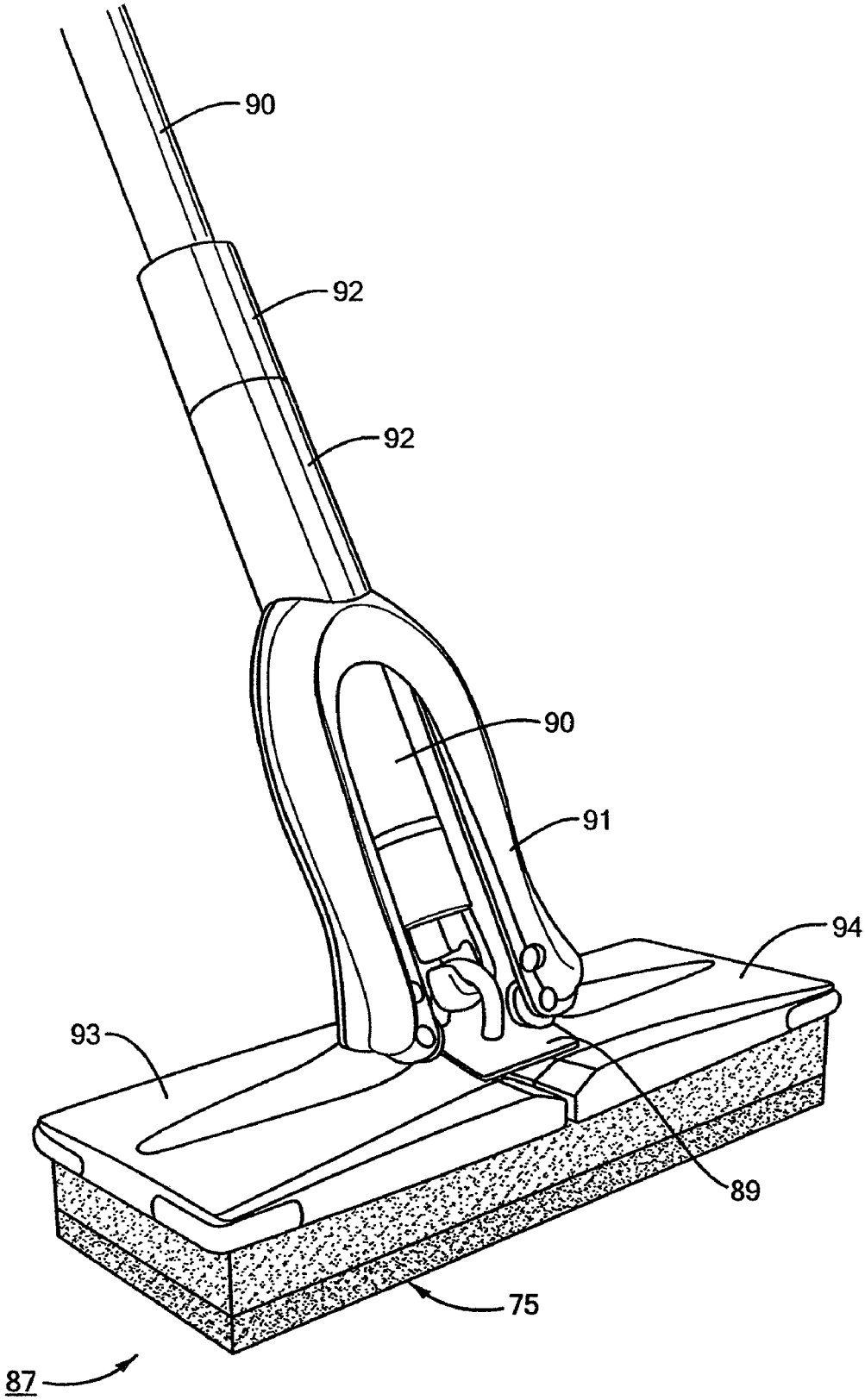
FIG. 9 is a fragmentary perspective view of a butterfly mop using the cleaning pad shown in FIG. 8.

In FIG. 9 is shown a fragmentary perspective view of butterfly mop constructed according to this invention and identified by reference numeral 87.

Butterfly mop 87 includes a head 89. An inner handle 90 is coupled to head 89. A yoke 91 is mounted on an outer handle 92. Inner handle 90 is movable within outer handle 92. A pair of hinged wing plates 93 and 94 are attached to head 89 and a cleaning pad 75 is removably mounted on wing plates 93 and 94. In use, outer handle 92 is pushed down with one hand while holding inner handle 90 with the other hand to cause wing plates 93 and 94 to fold to a closed position in order to extract liquid collected by cleaning pad 75.

Figure 10:
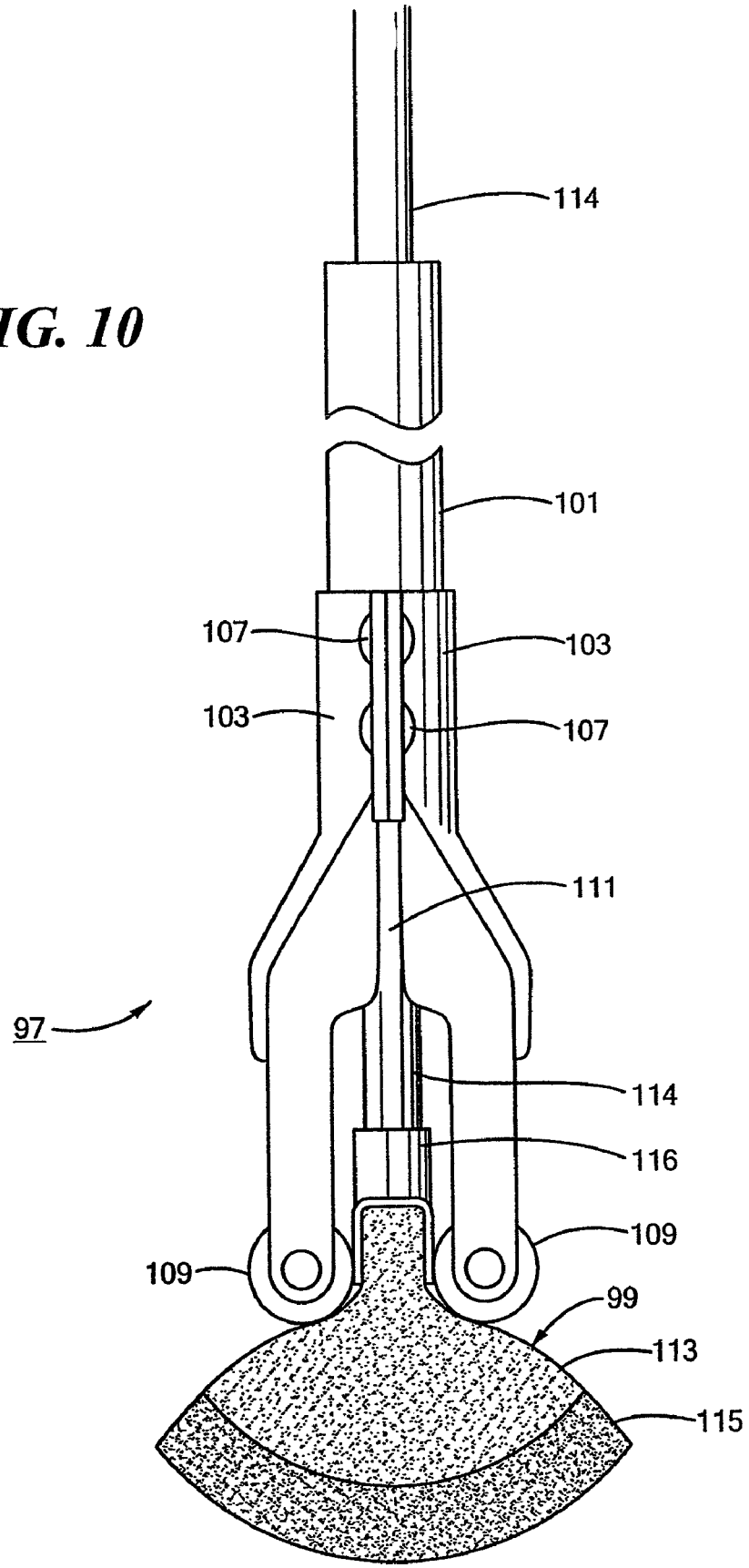
FIG. 10 is a fragmentary side section view of a roller mop constructed according to this invention.
Figure 11:
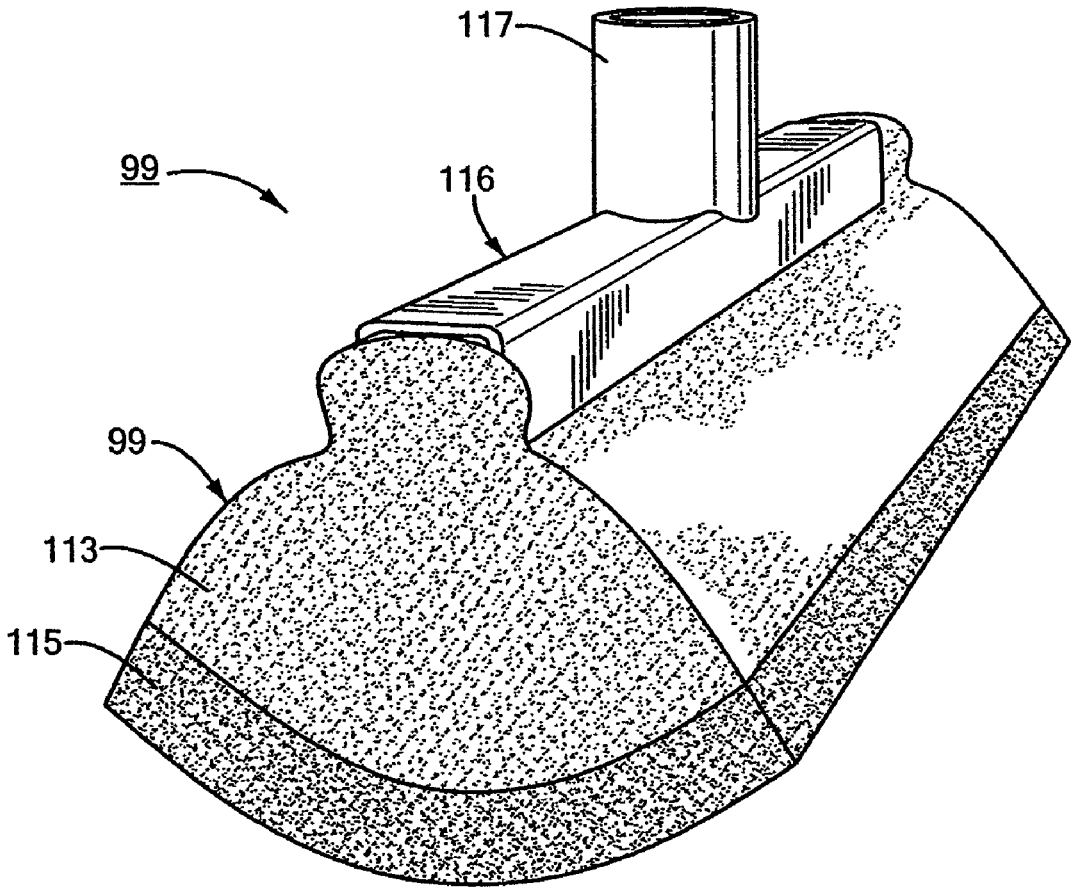
FIG. 11 is a perspective view of the cleaning pad shown in FIG. 10.

Referring now to FIG. 10 there is shown a fragmentary side section view of a roller mop constructed according to this invention and identified by reference numeral 97 and in FIG. 11 there is shown a perspective view of the cleaning pad for roller mop 97, the cleaning pad being identified by reference numeral 99.

Roller mop 97 includes a hollow tube 101. Hollow tube 101 is coupled at its lower end between two halves 103 of a hollow bell shaped housing 105 and secured together by rivets 107. Hollow tube 101 is internally threaded at its upper end to removably receive a handle 108. At the bottom end of each half 103 is a rotably mounted roller 109. An operating crank 111 is disposed within tube 101. Operating crank 111 is removably mounted at its lower end 114 to cleaning pad 99. Cleaning pad 99 includes a layer 113 of sponge material, a layer 115 of open cell foam material made from melamine resin which is bonded by any suitable means (not shown) to layer 113 of sponge material and an attachment structure 116. Attachment structure 116 is fixedly secured by any suitable means to layer 113. Attachment structure 116 includes an internally threaded bore 117 into which can be removably attached lower end 114 of crank 111.

Cleaning pad 99 can be used either as part of an original mop or as a refill for an existing mop.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A squeeze mop comprising:

(a) a handle, (b) a head attached to the handle, (c) a mounting plate on the head, (d) a disposable liquid absorbing cleaning pad, said disposable liquid absorbing cleaning pad comprising:

(i) a layer of a flexible open cell foam material made from melamine resin, wherein the layer of material made from melamine resin is greater than or equal to ⅛ inch in thickness, (ii) a layer of sponge material attached to said layer of a flexible open cell foam material, (iii) a backing plate mounted on the layer of sponge material, and (e) means for removably mounting the backing plate onto the mounting plate, and (f) a squeeze plate hingedly coupled to the mounting plate.

2. A butterfly mop comprising:

(a) a handle, (b) a head attached to the handle, the head including a base plate having a pair of hingedly connected base plates, (c) a disposable liquid absorbing cleaning pad, said disposable liquid absorbing cleaning pad comprising:

(i) a layer of a flexible open cell foam material made from melamine resin, (ii) a layer of sponge material attached to said layer of a flexible open cell foam material, wherein the layer of material made from melamine resin is greater than or equal to ⅛ inch in thickness, (iii) a backing plate mounted on the layer of sponge material, and (d) means for removably mounting the backing plate onto the pair of base plates.

3. A roller mop comprising:

(a) a handle, (b) an operating crank, (c) a disposable liquid absorbing cleaning pad, said disposable liquid absorbing cleaning pad comprising:

(i) a layer of a flexible open cell foam material made from melamine resin, wherein the layer of material made from melamine resin is greater than or equal to ⅛ inch in thickness, (ii) a layer of sponge material attached to said layer of a flexible open cell foam material, (iii) attachment structure mounted on the layer of sponge material, and (d) means for removably mounting the attachment structure onto the operating crank.

* * * * *